US006711764B1

(12) United States Patent
Mauze, Jr.

(10) Patent No.: US 6,711,764 B1
(45) Date of Patent: Mar. 30, 2004

(54) FAUX BAMBOO HAMMOCK STAND

(76) Inventor: Charles W. Mauze, Jr., 113 Ripley Rd., Wilson, NC (US) 27893

( * ) Notice: Subject to any disclaimer, the term of this patent is extended or adjusted under 35 U.S.C. 154(b) by 32 days.

(21) Appl. No.: 10/145,354

(22) Filed: May 14, 2002

(51) Int. Cl.[7] ..... A45F 3/24
(52) U.S. Cl. ..... 5/127; 5/120; 5/129
(58) Field of Search ..... 428/15, 17, 18, 428/27; 5/120, 127–130

(56) References Cited

U.S. PATENT DOCUMENTS

| | | | | | |
|---|---|---|---|---|---|
| 944,661 | A | * | 12/1909 | Buck | 5/129 |
| 3,632,273 | A | * | 1/1972 | Savickas | 425/392 |
| 4,473,605 | A | * | 9/1984 | Rausch | 428/17 |
| 4,975,997 | A | * | 12/1990 | Misiura et al. | 5/505.1 |
| 5,297,302 | A | * | 3/1994 | Anderson | 5/127 |
| 5,414,873 | A | * | 5/1995 | Wolf | 5/122 |
| 5,729,845 | A | * | 3/1998 | Hsu | 5/120 |
| D426,968 | S | * | 6/2000 | Rinaldi | D6/370 |
| 6,209,556 | B1 | * | 4/2001 | Yu | 135/15.1 |
| 6,383,588 | B1 | * | 5/2002 | You | 428/36.91 |
| D465,669 | S | * | 11/2002 | Gaylord et al. | D6/369 |
| D471,650 | S | * | 3/2003 | Dani | D25/126 |

FOREIGN PATENT DOCUMENTS

| | | | |
|---|---|---|---|
| GB | 2047156 A | * | 11/1980 |
| JP | 58-70863 | * | 4/1983 |
| JP | 5-69468 | * | 3/1993 |
| JP | 5-220809 | * | 8/1993 |
| JP | 9-94891 | * | 4/1997 |
| JP | 2002-191259 | * | 7/2002 |

* cited by examiner

*Primary Examiner*—Teri Pham Luu
(74) *Attorney, Agent, or Firm*—Mills Law Firm PLLC

(57) ABSTRACT

A hammock stand includes faux bamboo nodes formed periodically along the tubular component, which a color highlighted for simulating a bamboo appearance.

20 Claims, 5 Drawing Sheets

FAUX BAMBOO HAMMOCK STAND

FIELD OF THE INVENTION

The present invention relates to stands for hammocks and, in particular, to hammock stands having simulated bamboo components.

BACKGROUND OF THE INVENTION

Hammocks are a popular home and recreational accessories. In the past the hammocks have been primarily supported between permanently fixed locations such as trees, posts, walls or the like. For use where such support structure is not available, freestanding support stands have been increasingly available as representatively disclosed in U.S. Pat. No. 944,661 to Buck, U.S. Pat. No. 5,729,845 to Hsu, and U.S. Pat. No. 4,975,994 to Barmettler. These stands are formed using standard tubular materials, can be disassembled and transported to varying locations. Specialized components can be incorporated to provide styling variations to the basic support as disclosed in U.S. Pat. No. 5,414,873 to Wolf and U.S. Pat. No. 4,975,994 to Barmettler.

Other commercially available stands have features elaborate iron grillwork and laminated beams for making the stand an independent design statement. Such embellishments are costly, and more difficult to transport. Recently, hammock stands use a triple bar type construction have become popular, as representatively shown in U.S. Pat. No. 5,297,302 to Anderson. Therein a pair of transverse leg assemblies support upwardly diverging that are interconnected with a longitudinal base tube to provide a rigid self supporting framework. Support hooks are attached to the upper ends of the support tubes and a hammock attached thereto and suspended therebetween.

In view of the strength and safety considerations for the foregoing hammock stand construction, the components are typically formed of heavy gage steel tubing. The stands are available in a variety of painted, textured and brushed finishes to provide a weather resistance suitable for outdoor use. The décor of the stand, however, is generally secondary to styling of the hammock wherein woven ropes, wooden spreader bars and accessories are available in wide variety. In view of the foregoing limitations, it would be desirable to provide a hammock stand formed in shapes and styles not entirely dictated by the underlying components.

SUMMARY OF THE INVENTION

Hammocks are warm weather recreational and relaxation equipment, evoking a tropical environment and the associated lifestyle. Attendant accessories oftentimes expand on the theme, using wicker, rattan, and like materials for chairs, rockers, footrests, swings and the like. Highly synonymous with this setting is bamboo-based construction wherein natural and replicated bamboo materials are used in the construction and decoration of accessory products.

The present invention provides a hammock stand that affords a simulated bamboo appearance, without sacrificing the strength, durability and safety of conventional, freestanding hammock stands. Herein, the conventional tubular stand is enhanced with structural accents in the form of replications of bamboo culms including nodes, sheath scars and internodes, spatially configured and coated to replicate and connote the unique features of their natural counterparts. Such features are achieved by providing periodically along the length of the tubular components conically flared and styled nodal areas formed of a formable polymeric coating that is bonded to the outer surface of the component. A preferable coating is a flowable thixoptropic material such as polyurethane, polyester, polyurea and hybrid mixtures. Commercially available formulations used in auto body repair, such as Bondo Body Filler, are well suited for adherence to the tubes, detailing before curing, and satisfactory cured strength. A typical node will have a generally conical flare terminating at a transition band with a succeeding internode section of the simulated culm. The nodes are provided with longitudinal indentations of sheath-scars, the locus of a detached leaf. The molded tube is primed and base coated with a primary bamboo color, streaked longitudinally to accent rib striates, with the nodal transitions highlighted with accent colors indicative of natural contrasts. The resulting hammock stand, with the faux bamboo contours and colorations, captures the exotic and mystical aura of tropical settings.

Accordingly, it is an object of the present invention to enhance of styling of triple beam hammock stands.

Another object of the invention is to provide a tubular hammock stand having a faux bamboo finish.

A further object of the invention is to provide faux bamboo tubular articles by integrally forming periodic flaring nodal areas connected with internodal tubular area, and finishing with coloration replicating natural bamboo materials.

BRIEF DESCRIPTION OF THE DRAWINGS

The above and other features and advantages of the present invention will become apparent upon reading the following written description taken in conjunction with the accompanying drawings in which.

DESCRIPTION OF THE PREFERRED EMBODIMENTS

Figure 1:
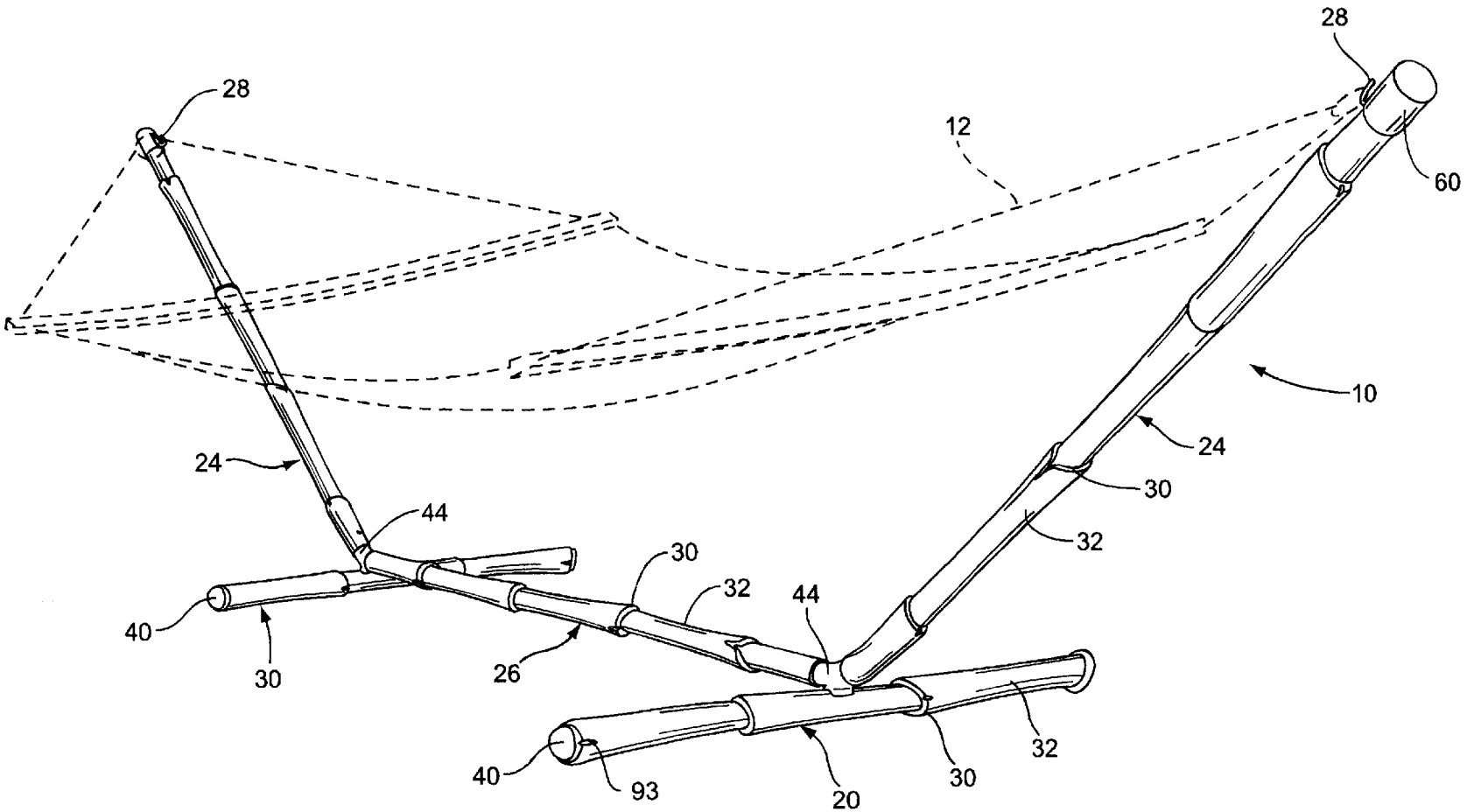
FIG. 1 is a perspective view of a hammock stand and hammock in accordance with a preferred embodiment of the invention.

Referring to the drawings for the purpose of described embodiment only and not for limiting same, FIG. 1 shows a faux bamboo hammock stand 10 supporting at upper longitudinal ends thereof a conventional hammock 12 shown in dashed lines.

The stand 10 comprises a pair of longitudinally spaced leg tubes 20 operatively connected to a pair of longitudinally disposed, outwardly and upwardly diverging support tubes 24 and interconnected by a base tube 26. The inner upper ends of the support tubes 24 include hooks 28 for suspending the hammock 12.

Figure 2:
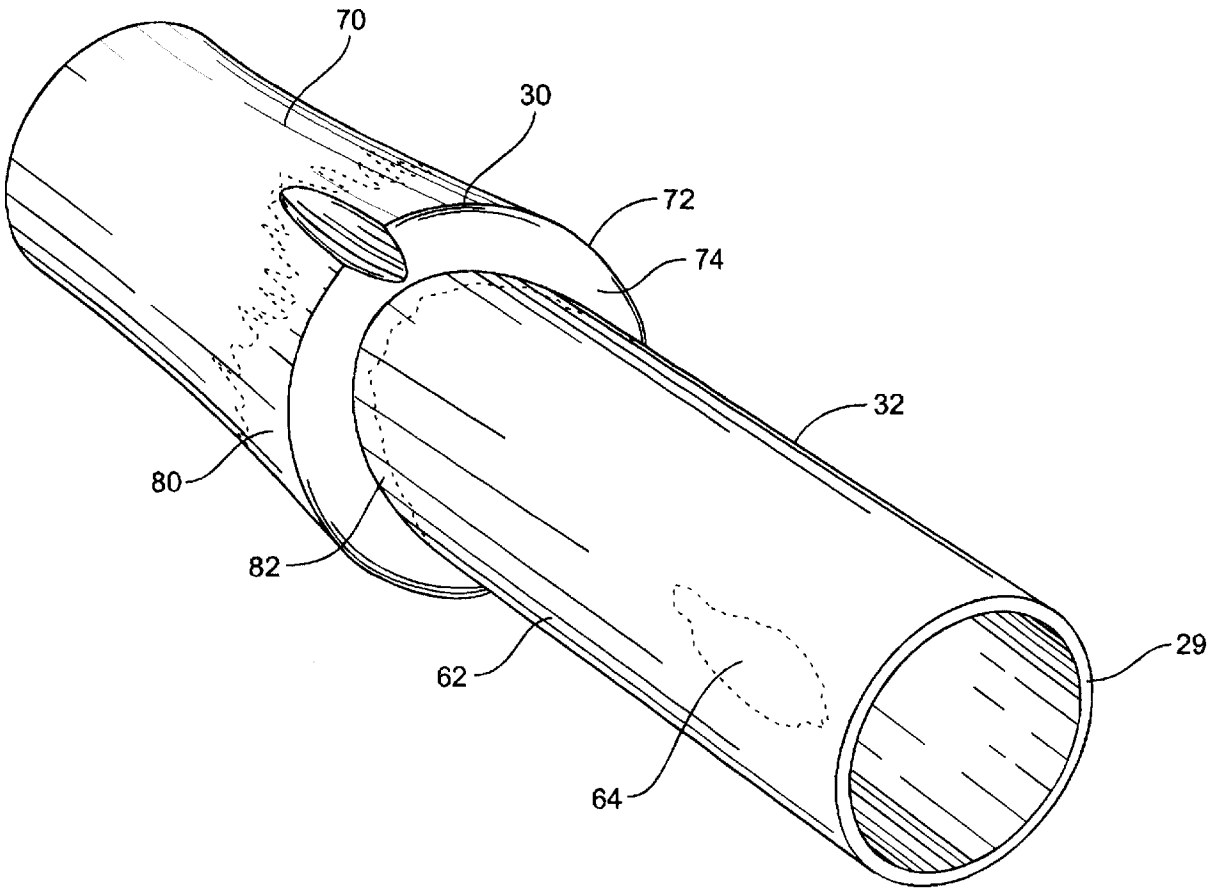
FIG. 2 is a fragmentary perspective view of a hammock stand tube having a culm section including a node and an internode.
Figure 3:
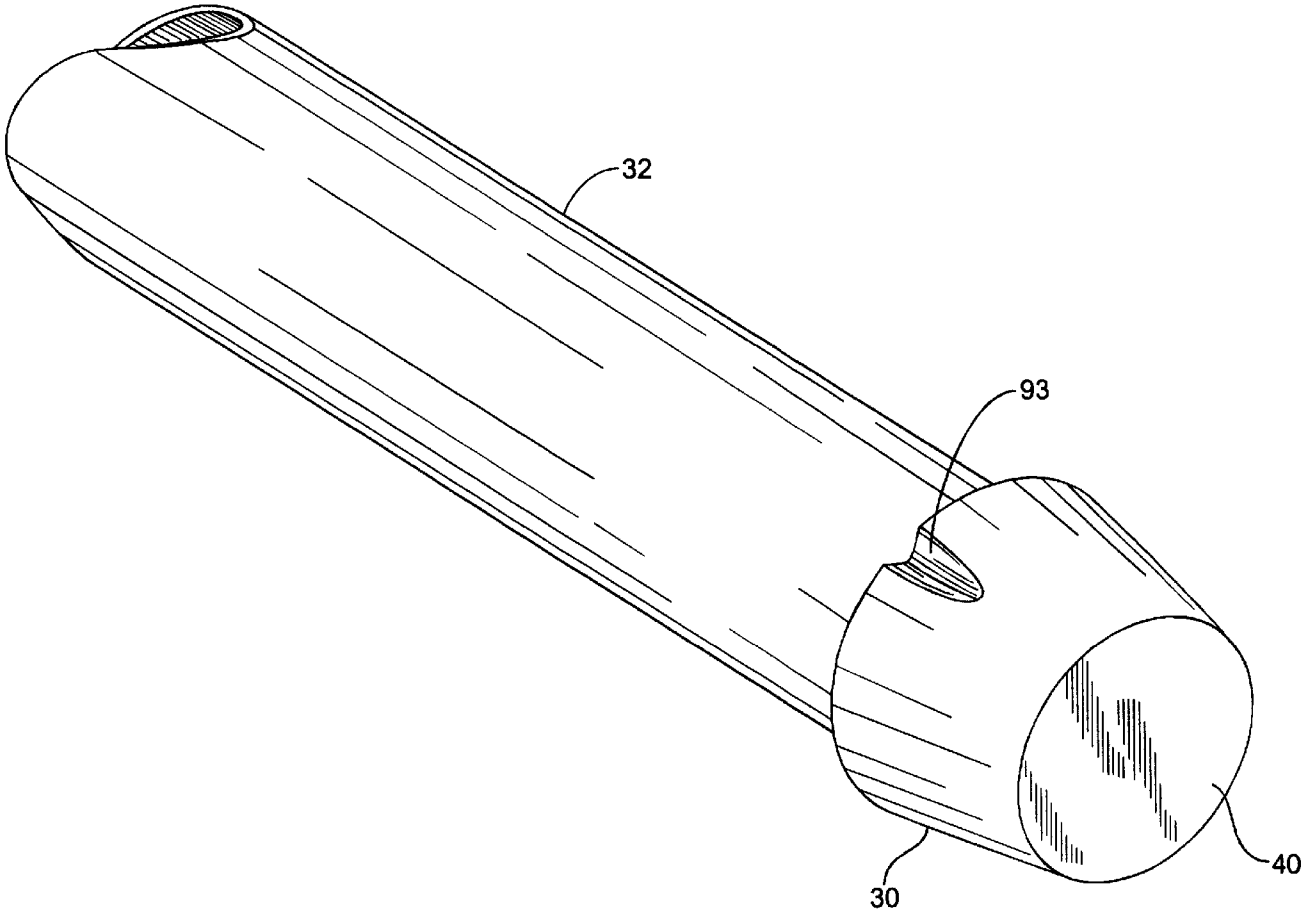
FIG. 3 is a fragmentary view of a leg tube end cap.
Figure 4:
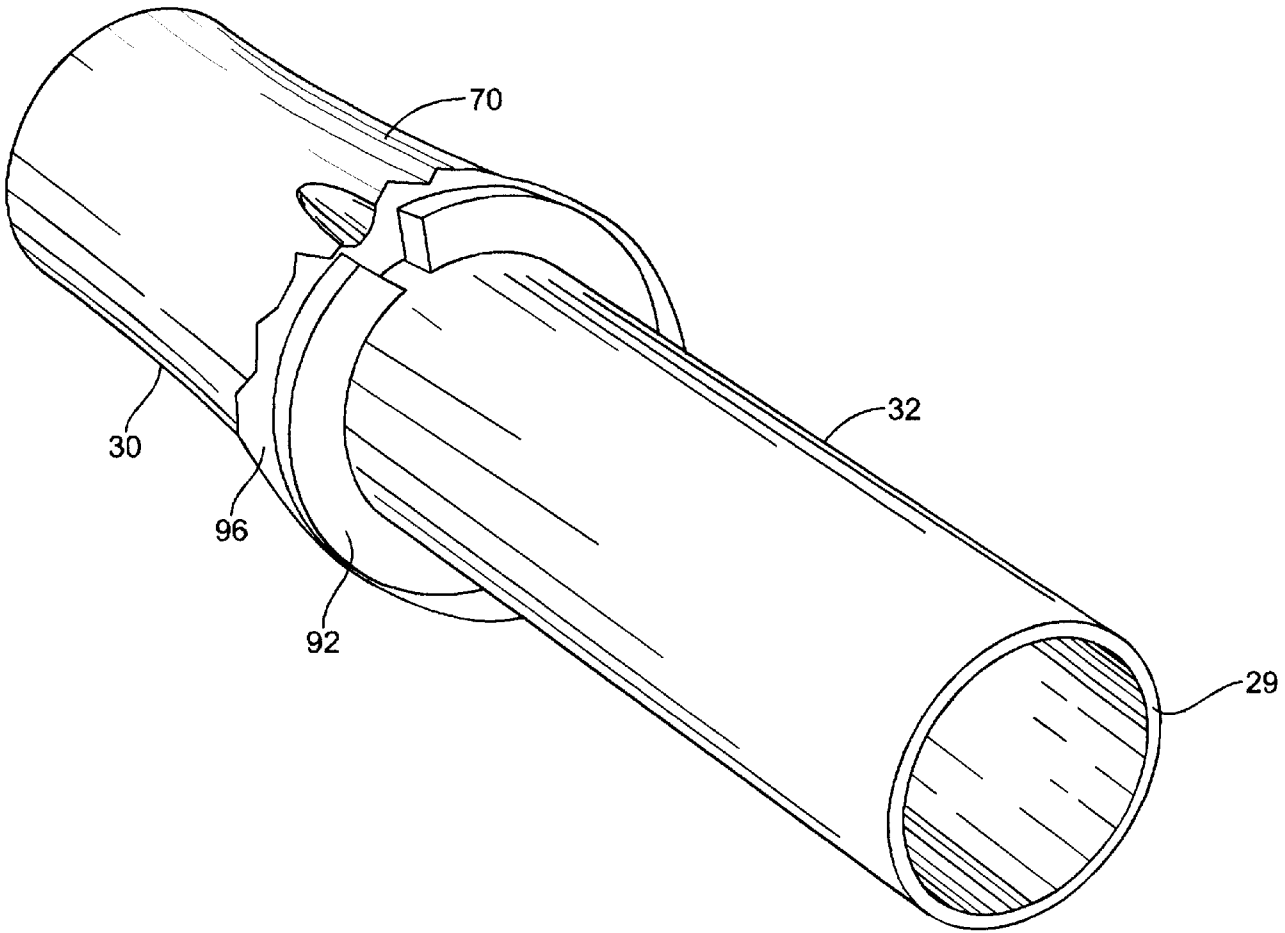
FIG. 4 is a fragmentary progressively sectioned perspective view of a culm node illustrating the reinforcing ring.

Referring to FIGS. 2 through 4, the leg tubes 20, the support tubes 24 and the base tube 26 are elongated tubular members having a cylindrical core 29 of heavy gauge steel. Each tube comprises periodic bamboo culm sections including replicated bamboo nodes 30 longitudinally spaced by replicate culm internodes 32, and are stylistically suggestive of bamboo plants. The ends of the leg tubes 30 are provided with protective and decorative end caps 40 as shown in FIG. 4.

Each leg tube 20 includes a support nipple 44 that is centrally fixedly attached to the upper portion thereof, generally by welding. The nipple 44 is also a tubular member. The nipple 44 is disposed transverse to the leg tube 22 at the center thereof The nipple 44 comprises a horizontal lower disposed inwardly of the leg tube 20 and an upper arm obliquely disposed outwardly of the leg tube 20 and extending upwardly and outwardly at a shallow angle of about 30° or other suitable orientation. The lower arm is telescopically inserted into the outer end of the base tube 26. The upper arm 52 is telescopically inserted into the lower end of the support tube 24. The connection between the nipple and the tubes may comprise a frictional fit, or enhanced with a releasable locking mechanism.

Each support tube 24 includes a mounting cap assembly 60 telescopically received at the upper end thereof The cap assembly 60 includes the mounting hook 62. The other end of the mounting hook 28 is connected with the support chain of the hammock 12.

Referring to FIGS. 2 through 6, each bamboo section includes the node 30 and the internode 32. The internode is a decoratively coated section of the core tubing and includes circumferentially spaced random striations 62 and intermittent blemishes 64, both of which are suggestive of natural conditions in bamboo. The node 30 has a generally frustoconical surface 70 extending from the internode and terminating at a circumferential rim 72 with a reverse frustoconical annular band 74 suggestive of an annular nodal termination band. The rim 72 lies in a plane inclined with respect to the axis 76 of the associated tube section, also suggestive of nodal termination in native bamboo plants. An angle of about 45° to 75° produces attractive simulation, with an angle in the order of about 60° preferred. The band 74 and outer surfaces of adjacent sections 80 and 82 of the node and internode are provided with contrasting coloration to the internode, further suggestive of the coloration contrasts in natural material.

Figure 5:
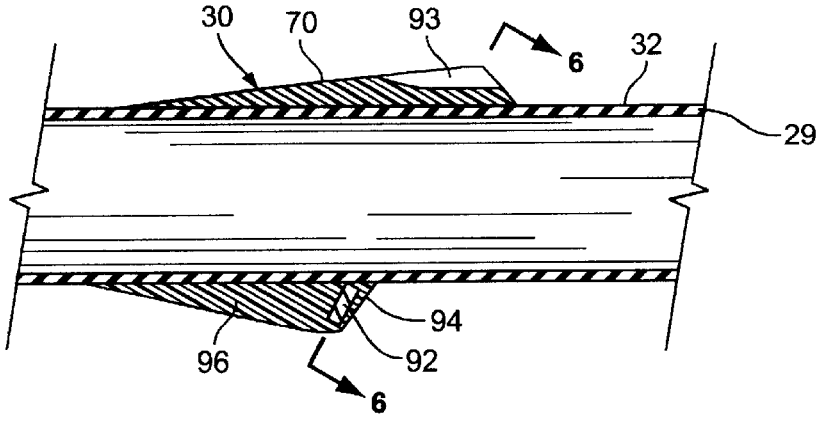
FIG. 5 is a side elevational view of a culm node on a tube.
Figure 6:
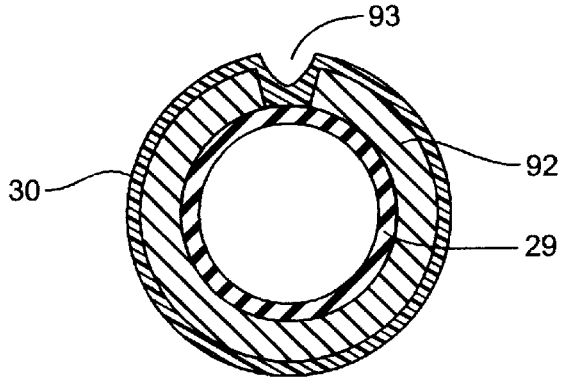
FIG. 6 is an end view of the culm node taken along line 6—6 in FIG. 5.

Referring to FIGS. 4 through 6, the node 30 is formed and defined by a frustoconical collar 90 adhered to the outer surface of the core 29. The collar 90 comprises an inclined split annular ring 92 bounded on either side by a front section 94 and a rear section 96, the later of which are formed of a formable material. The ring 92 is inclined substantially the same as the rim 72, having an inner diameter sufficiently larger than the outer diameter of the tube to accommodate the orientation. The ring 92 may be welded or otherwise fixed to the tube. The filling material is applied manually to the tube and against the ring and sculpted to the desired contour thereby encasing the ring 92. An outwardly opening sheath scar groove 93 is formed in the outer surface prior to material setting through the circumferential gap in the ring. Additionally, the ring provides supplemental bonding surfaces for the filling material and reinforces the nodal definition.

The node sections 94, 96 are formed of a structural material, natural or synthetic suitable for the desired surface contouring and compatible with the strength requirements of the stand. Preferably, the collar is a formable polymeric coating that may be locally applied and formed before curing. Suitable materials are flowable thixotropic polymeric formulations including polyurethanes, polyester, polyureas and hybrid mixtures. Commercially available formulations used in auto body repair, such as Bondo Body Filler, are well suited for adherence to the tubes, permit detail forming before curing, and satisfactory cured strength.

Figure 7:
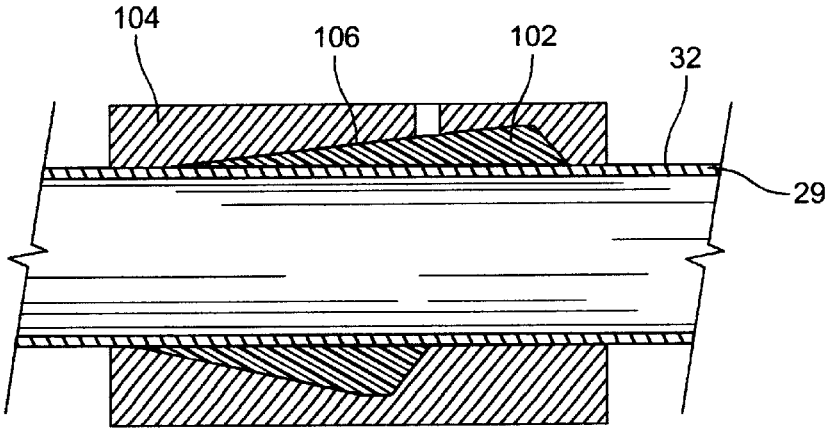
FIG. 7 is a side elevational view of a tube and mold for casting a culm node in accordance with another embodiment of the invention.

Referring to FIGS. 7, the node section 100 may also be molded directly onto the tube 102 by surrounding the tube with a mold 104 having an inner mold surface 106 corresponding to the nodal configuration defining a mold cavity, filling the mold cavity with a liquid material suitable for casting, such as iron or alloyed material, allowing the material to harden, removing the mold, and surface finishing the exterior using conventional techniques. The nodal collar may also be established by preformed elements secured by suitable means such as adhesives to the tube.

The finished tube element may be finished with desired highlighting and coloration. In a preferred rendition, the internode is formed with a base final color and streaking with a contrasting color for simulating natural striations is effected by conventional techniques. For example, a yellow shade provides dramatic results for the base coloration. The striated coloration may be blended with a darker coloration at the ends of the node and the transition band to the internode using the striation color, preferably a brown shade.

While the present invention has been described with reference to hammock stands, it will be appreciated that other decorative pieces using tubular construction may also achieve a desired faux bamboo design, utilizing the above described techniques, it will be appreciated that varying styling renditions of bamboo can be achieved utilizing the above described construction to achieve designs associated with varying real and fanciful bamboo species. Each, however, will having the underlying rigidity and proven manufacture of tubular construction, with definition enhanced by the periodic bamboo node and surface compatibility for decoration with bamboo colorization and features.

Having thus described presently preferred embodiments of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A hammock support stand comprising: an elongated base tube having transverse leg tubes and upwardly and outwardly inclined support tubes connected at ends thereof wherein said tubes are formed of heavy gage steel tubing, the upper ends of said support tubes including means for supporting a hammock therebetween, at least one of said tubes includes a plurality of frustoconical nodes formed of a polymeric coating material bonded to the outer surfaces of said tubes and spaced periodically along the length thereof establishing a bamboo node configuration wherein the node and the tube surfaces therebetween are coated with a faux bamboo finish.

2. The hammock support stand as recited in claim 1 wherein a plurality of said tubes include said frustoconical nodes.

3. The hammock stand as recited in claim 2 wherein said nodes include a first conical surface and an annular surface intersecting at a cylindrical rim.

4. The hammock stand as recited in claim 3 wherein said annular surface is a second conical surface extending between said rim and the outer surface of said tube.

5. The hammock stand as recited in claim 4 wherein said rim is inclined with respect to said tube.

6. The hammock stand as recited in claim 5 including an outwardly opening groove formed in said conical surfaces and said rim.

7. The hammock stand as recited in claim 6 wherein said tube is provided with a first faux bamboo surface and said nodes are provided with a contrasting second faux bamboo surface.

8. The hammock stand as recited in claim 1 wherein said polymeric coating material is a polymeric thixotropic material selected from the group comprising polyurethanes, polyesters, polyureas and mixtures thereof.

9. A faux bamboo component comprising: an elongated tubular element formed of heavy gage steel, said tubular element having frustoconical nodes formed at spaced locations along the length of the outer surface thereof wherein said nodes are a solid material formed in situ on said outer surface of said tubular element, and a coating on said element and said nodes having a faux bamboo coloration.

10. The bamboo component as recited in claim 9 wherein said nodes include a conical surface diverging outwardly from said outer surface and terminating with a cylindrical rim, and an annular surface extending between said rim and the adjacent tubular element.

11. The bamboo component as recited in claim 10 wherein said cylindrical rim is inclined with respect to said tubular element in the range of about 45° to 75°.

12. The bamboo component as recited in claim 11 wherein said cylindrical rim is inclined with respect to said tubular element in the range of about 60°.

13. The bamboo component as recited in claim 10 wherein said annular surface is a conical surface diverging inwardly from said cylindrical rim.

14. The bamboo component as recited in claim 10 including an outwardly opening axially extending groove formed in said nodes and said rim.

15. The bamboo component as recited in claim 14 wherein the portions of said tubular element between said nodes is provided with a faux striated coloration.

16. The bamboo component as recited in claim 15 wherein said nodes are provided with a solid coloration contrasting said striated coloration.

17. The bamboo component as recited in claim 14 wherein said frustoconical node is formed of a flowable thixotropic material.

18. The bamboo component as recited in claim 17 wherein an annular ring is encapsulated by said thixotropic material.

19. The bamboo component as recited in claim 18 wherein said annular ring is inclined with respect to said tubular element.

20. The bamboo component as recited in claim 18 wherein said annular ring is provided with a circumferential gap at groove.

* * * * *